United States Patent [19]

Dubinsky

[11] 4,367,762

[45] Jan. 11, 1983

[54] UMBRELLA COVER AND METHOD OF MAKING

[76] Inventor: Emanuel Dubinsky, 99 Kingston Ave., Yonkers, N.Y. 10704

[21] Appl. No.: 241,020

[22] Filed: Mar. 6, 1981

Related U.S. Application Data

[63] Continuation-in-part of Ser. No. 220,119, Dec. 24, 1980.

[51] Int. Cl.[3] ..... A45B 25/24

[52] U.S. Cl. ..... 135/33 C

[58] Field of Search ..... 47/20, 21, 22, 28 R, 47/28.1, 29; 135/33 R, 33 C, 34, 36 F; 150/DIG. 1

[56] References Cited

U.S. PATENT DOCUMENTS

| | | | |
|---|---|---|---|
| 442,991 | 12/1890 | McKevit | 135/33 C |
| 1,233,099 | 7/1917 | Miller | 47/21 |
| 1,820,040 | 8/1931 | Zuckerman | 47/22 |
| 1,834,084 | 12/1931 | Barnes | 47/21 |
| 2,789,571 | 4/1957 | Kurman | 135/33 C |
| 3,431,926 | 3/1969 | Dubinsky | 135/34 |
| 3,490,469 | 1/1970 | Dubinsky | 135/33 C |
| 4,062,370 | 12/1977 | Brickner | 135/33 C |

FOREIGN PATENT DOCUMENTS 2807305 8/1979 Fed. Rep. of Germany .... 135/33 C

*Primary Examiner*—Harland S. Skogquist

*Attorney, Agent, or Firm*—Hubbell, Cohen, Stiefel & Gross

[57] ABSTRACT

An umbrella cover (10, 100) is provided in which a sleeve (10, 100) contains a substantially rigid telescoping support rod (20) which enables the cover (10, 100) to be readily mounted on an umbrella canopy (12) while facilitating compact storage of the cover (10, 100). The lower end of the sleeve (10) may include a flap portion (16) which is folded back to form a cuff (24) prior to lifting the cover (10) over the umbrella (12) or the sleeve (100) may include a partial triangular cut out (104) in the front side (106) which has as its backing, a portion (114) of the interior of the rear side (112) of the cover (100) in place of the cuff arrangement (24). In either instance, the rigid rod (20) is retained in a pocket (22, 124) formed in the sleeve (10, 100). The pocket (124) extends along one edge of the backing member (114) to add ridigness while the cut out (104) facilitates mounting of the sleeve (100) over the umbrella canopy (12). The sleeve (100) may be made from a single blank (102) of material with appropriate cutting, folding and stitching.

10 Claims, 7 Drawing Figures

UMBRELLA COVER AND METHOD OF MAKING

CROSS-REFERENCE TO RELATED APPLICATIONS

This application is a continuation-in-part of my copending U.S. patent application Ser. No. 220,119 filed Dec. 24, 1980, and entitled "Umbrella Cover".

TECHNICAL FIELD

The present invention relates to protective umbrella covers, and particularly to such covers which may be easily mounted and dismounted from the canopy of an umbrella, while being compactly storable when not in use.

BACKGROUND ART

Umbrella covers are well known in the art such as disclosed in my earlier U.S. Pat. No. 3,490,469, and in U.S. Pat. No. 4,062,370. With respect to my earlier U.S. Pat. No. 3,490,469, although the umbrella cover described therein is satisfactory for most purposes, it contains certain features which are not as desirable from a manufacturing and storage standpoint. Namely, this cover utilizes a zipper closure for a slit extending substantially the entire length of the cover as well as having an assembled rod which also extends for substantially the entire length of the cover. While these features help facilitate usage of the cover, they can be disadvantageous from a manufacturing and storage standpoint in that the long rod may make storage or packaging of the cover cumbersome, and the zipper may rust if made of metal or may experience difficulty in opening if made of plastic.

As discussed in U.S. Pat. No. 4,062,370, in an effort to overcome some of those disadvantages, an umbrella cover may be provided which does not have a zipper closure in that it forms an envelope, similar to that disclosed in U.S. Pat. No. 1,820,040 for use on trees. However, such a cover does not have an installed rigid support but rather relies on the use of a pole whose tip is slipped into a pocket to lift the cover on and off the umbrella. This arrangement is unsatisfactory and is less advantageous in use than the prior art arrangement of U.S. Pat. No. 3,490,469. Thus in attempting to solve some of the potential manufacturing and storage difficulties of the arrangement disclosed in U.S. Pat. No. 3,490,469, the arrangement disclosed in U.S. Pat. No. 4,062,370 reintroduces the usage disadvantages previously overcome by the arrangement disclosed in U.S. Pat. No. 3,490,469. In addition, applicant is not aware of any satisfactory prior art manufacturing methods in which an umbrella cover capable of retaining an installed rigid support rod can be readily made from a single blank of material. Thus, applicant is not presently aware of any satisfactory prior art arrangement which is advantageous not only in usage but in manufacturing and storage as well.

These disadvantages of the prior art are overcome by the present invention.

DISCLOSURE OF THE INVENTION

A protective umbrella cover is provided in which a sleeve of substantially pliable material contains a substantially rigid telescoping support rod partially extending along the length of the sleeve, whereby the cover may be readily mounted upon an umbrella canopy with the support rod telescopically extended and coverage of the canopy completed by telescopic closure of the rod. The sleeve comprises a front and rear side and has an upper and lower end, with the lower end being open to receive the canopy of the umbrella. The front side has an upwardly extending aperture, such as one of triangular shape, which goes from the lower end of the sleeve to one edge so as to expose a portion of the interior of the opposed rear side which forms a backing member for the aperture. A pocket for retaining the support rod runs along the one edge through the aperture and extends for substantially half the length of the sleeve which facilitates storage and packaging of the cover. In use, the support rod and the backing member cooperate to facilitate mounting of the cover over an umbrella canopy. As the cover is brought down over the canopy, the rod retracts until the cover is fully in position. In manufacturing the cover, a single blank of material may be employed in which the aperture and a flap for forming the pocket are cut out. The material and the flap are then folded so as to have a common edge, with one end of the folded flap folded over to close it, and the sleeve is then formed with the pocket by stitching along the outer edge.

BEST MODE FOR CARRYING OUT THE INVENTION

Figure 1:
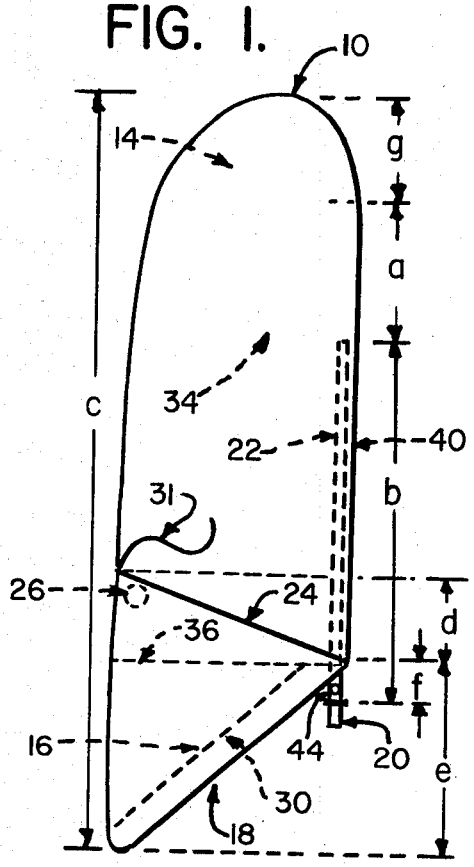
FIG. 1 is side elevational view of an umbrella cover in accordance with the present invention described in my copending U.S. patent application Ser. No. 220,119, filed Dec. 24, 1980, and entitled "Umbrella Cover"

Referring now to the drawings in detail and initially to FIGS. 1–5 thereof, a protective umbrella cover, generally referred to by the reference numeral 10, in accordance with the present invention is shown. This cover 10 is the cover which is described in my copending U.S. patent application Ser. No. 220,119, filed Dec. 24, 1980 and entitled "Umbrella Cover". The umbrella cover as will be explained in greater detail hereinafter, is preferably arranged to be lifted over a conventional umbrella canopy 12 such as a garden or bench umbrella, and pulled down to form a protective covering for the umbrella 12. In addition, as will also be explained in greater detail hereinafter the cover 10, which is preferably formed of a soft pliable material, such as vinyl or weather protected fabric, is constructed so as to be compactly storable and/or packaged.

As shown and preferred in FIG. 1, the cover 10 may generally be of a tapered configuration having a peak portion 14 at the uper end and a flap portion 16 at the bottom end. The cover 10 forms a sleeve, with the cover 10 being mountable over the umbrella canopy 12 through the opening 18 at the bottom of the sleeve 10. Preferably a telescoping rigid support rod 20 is secured in the sleeve 10 such as by being sewn in a pocket 22 formed along one side of the sleeve 10. The flap portion 16, as will be described in greater detail hereinafter, is preferably foldable up to form a tricorner configured cuff 24 which is temporarily securable in this configuration to the outside of the sleeve 10 by means of Velcro fasteners 26 or some other type of temporary attachment means. An inner circumferential stiffening member of reinforcing strip or band 30, such as one formed from a plastic or vinyl webbing of the type used for tubular furniture, such as a 12 gauge, two inch wide webbing strip, is preferably located within the interior of the sleeve 10 along the fold line for the flap portion 16 so as to reinforce the bottom opening 18 of the sleeve 10 when the flap portion 16 forms the cuff 24 and, thereby, keep the bottom of the cover 10 open and facilitate placement of the cover 10 over the canopy 12. The flap portion 16 preferably includes a conventional drawstring 31 at the bottom to enable the mounted cover 10 to be tied closed. The triangular configured cuff 24 formed by position 16 necessitates provision of a longitudinal slit 32 (FIG. 5) having a longitudinal extent e equal to the height of the triangular space formed when the cuff 24 is formed.

Figure 2:
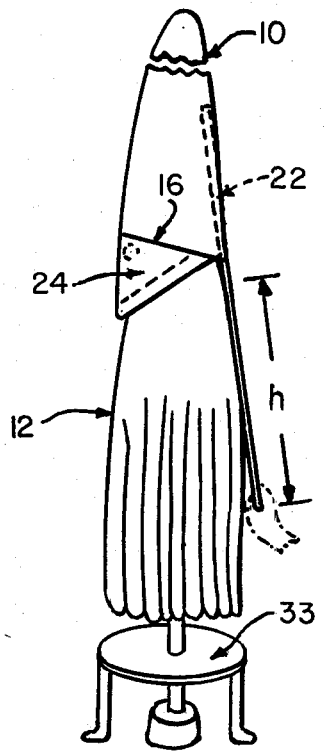
FIG. 2 is a diagrammatic illustration showing the manner in which the cover of FIG. 1 is lifted over an umbrella canopy.
Figure 3:
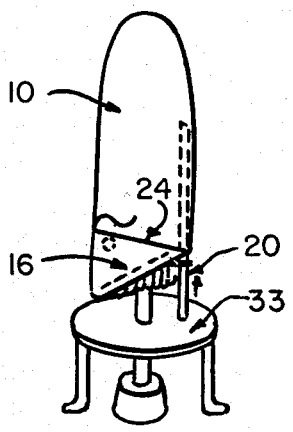
FIG. 3 is a diagrammatic illustration, similar to FIG. 2, illustrating the cover of FIG. 1 in position over the umbrella canopy prior to completion of the covering procedure.

As will be described hereinafter the telescoping supporting rod 20 enables the secured rod 20 to be extended to its full length to facilitate lifting of the cover 10 over the canopy 12 while enabling the rod 20 to be retracted as the cover 10 is being brought down over the umbrella 12 and the rod 20 contacts a table top 33, as illustrated in FIG. 3. In addition, the telescoped rod 20 enables this removed cover 10 to be folded along fold lines 34 and 36 to form a compact storage assembly. By way of example, as shown in FIGS. 1 and 2, for conventional garden type umbrellas, the approximate relative dimensions of the cover 10, using the reference letters a,b,c,d,e,f,g and h, are as follows: a=22 inches, b=30 inches, c=70 inches, d=e=15 inches, f=1 inch, g=4 inches and h=30 inches with approximately an additional 2 inch overlap of the two portions of the telescoping rod 20. The telescoping rod 20 preferably has the two portions secured to each other by a conventional umbrella type spring lock 44 which when pushed in will enable the rod 20 to be extended to its full height or will enable the rod 20 to be retracted as a result of upward pressure against the bottom portion of the rod 20.

Figure 4:
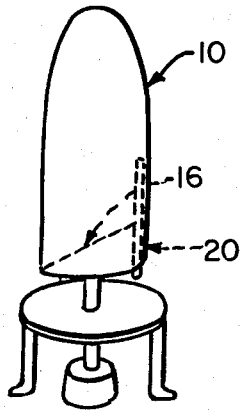
FIG. 4 is a diagrammatic illustration, similar to FIG. 3, with the covering procedure completed.
Figure 5:
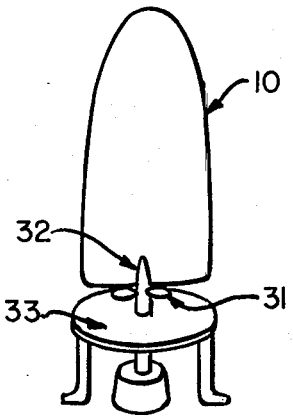
FIG. 5 is a diagrammatic illustration, similar to FIG. 4, showing a front view of the cover in position with the covering procedure completed.

Referring now to FIGS. 2–5, the cover 10 is preferably used as follows. The flap portion 16 is folded up to form the triangular cuff 24, if not already in this position, and temporarily secured in place by fasteners 26, with one cuff 24 being formed on each of the two sides of the cover 10. The spring, lock 44 on the rod 20 is then pushed in and the rod 20 is then extended to its full length, as shown in FIG. 2, and the cover 10 is lifted over the umbrella canopy 12. Once the cover 10 is over the umbrella 12, the sewn in portion 40 of the rod 20 and the reinforced bottom portion 30 of the cover 10 enables the cover 10 to readily fall into place about halfway down on the umbrella 12. As the user continues to pull the cover 10 down over the umbrella 12, the bottom of the rod 20 contacts the table top 33 (FIG. 3) and, the user again pushes in the spring lock 44 releasing 14. The continued pressure of the rod 20 against the table top 33 as the cover 10 is thereafter pulled downward by the user will cause the rod 20 to telescope back and retract until the cover 10 is completely in position. If the rod 20 did not retract, it could interfere with the cover 10 being fully placed in position because of the table top 33. Thereafter, the rod 20 may be locked in the retracted position due to a second conventional detent on the bottom portion of the rod 20. The flap portions 16 are then separated from the fasteners 26 on the sleeve 10 and the flaps 16 are then folded down (FIG. 4). If desired, the drawstring 31 may be pulled tight and tied to complete the installation of the cover 10 on the umbrella 12. To remove and store the cover, the above procedure is reversed. When the cover 10 is removed and the rod 20 has been retracted, the cover 10 may be refolded along fold lines 34 and 36 and stored in a compact package whose overall height would be the height b of the upper portion of the telescoping rod 20.

Figure 6:
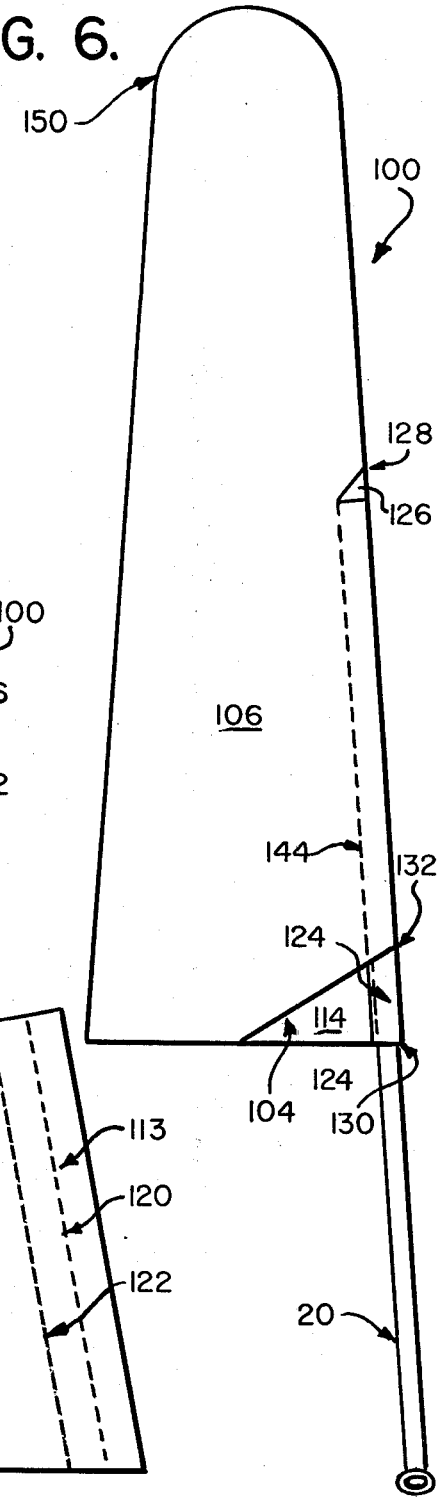
FIG. 6 is a side elevational view, similar to FIG. 1 of the presently preferred embodiment of an umbrella cover in accordance with the present invention.
Figure 7:
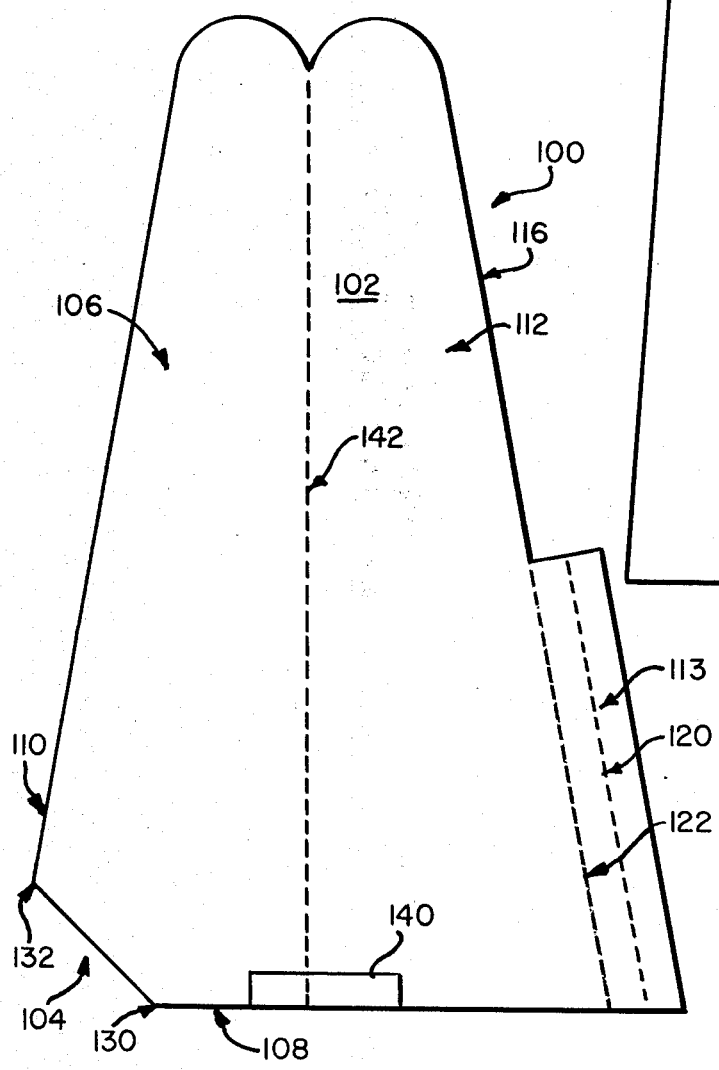
FIG. 7 is a diagrammatic illustration of a single blank from which the cover of FIG. 6 can be made in accordance with the presently preferred method of the present invention.

Referring now to FIGS. 6 and 7 the presently preferred embodiment of the umbrella cover of the present invention, generally referred to by the reference numeral 100, is shown. This cover 100, as will be described in greater detail hereinafter, may preferably be formed from a single blank of material 102 with appropriate cutting, folding, and stitching to provide a cover 100 which functions in essentially the same manner as the previously described cover 10 of FIGS. 1–5 without the necessity for a cuff 24, and which is considerably easier to manufacture. In place of the cuff arrangement 24 of the cover 10 of FIGS. 1–5, the cover 100 of FIGS. 6–7 includes a triangular aperture 104 in the top or front side 106 of the cover 100 which is provided by a cut extending from the bottom end 108 of the blank 102 from which the cover 100 is formed up to one edge 110. As shown and preferred in FIGS. 6–7, no such aperture 104 is present in the bottom or rear side 112 of the cover 100 so that the interior of the bottom portion 114 of this rear side 112 forms a backing member 114 for aperture 104 in the completed cover 100 illustrated in FIG. 6. As further shown and preferred in FIGS. 6–7, the opposite edge 116 of the blank 102 has a flap portion 113 extending therefrom which, when folded inwardly along longitudal axis or fold line 120 and again along fold line 122 which is congruent with the edge 116, is used to form a pocket 124 for the telescoping rigid support rod 20 in the completed cover 100 of FIG. 6. A closed upper end 126 for the formed pocket 124 is formed by folding down the upper end of the folded flap 113 prior to sewing. When the rigid rod 20 has been inserted in the pocket 124 of the completed cover 100, the cover 100 is made rigid from point 128 to point 130 (FIG. 6). The rod 20 is then extended, as in the previous embodiment 10, and the cover 100 is now ready to be placed on the umbrella canopy similar to the arrangement illustrated in FIG. 2 with the exception that in place of the cuff 24, the umbrella canopy is now pressed slightly against backing member 114, with the rigidness between points 132 and 130 (FIG. 6) allowing the cover to be pushed open thereby readying the cover 100 to be placed over the umbrella canopy. The rigid section provided between points 128 and 130 due to rod 20 then keeps the cover 100 straight and upright as it is pulled down over the umbrella canopy, such as through the help of gravity and force applied by the user. As was referred to in the embodiment 10 of FIGS. 1–5, as the rod 20 strikes the table top, it will retract as illustrated in FIG. 3 and thereafter the rod 20 is telescoped into the cover 100, such as shown in FIG. 4 and the drawstrings are tied. As further shown and preferred in FIG. 7, an additional stiffening member 140, such as a vinyl strap, may be provided inside the cover 100 adjacent the bottom 108 to assist in keeping the cover 100 open until the cover 100 is ready to be dropped into place over the umbrella canopy.

Referring now to FIG. 7, the presently preferred method of the present invention for manufacturing the cover 100 from a single blank 102 of material shall be described. As shown and preferred in FIG. 7, the blank 102 is cut to the desired shape and size to provide the front 106 and rear 112 of the cover 100 as well as flap 113 from which the pocket 124 is formed, with the flap 113 extending from edge 116 and with aperture 104 being provided in front 106. If stiffening member 140 is to be employed, it is secured to the inside of blank 102 as shown. Flap 113 is then folded inwardly twice along fold lines 120 and 122, and thereafter folded at the top to form closed end 126. The blank 102 is then folded along fold line 142, which is essentially the longitudinal axis of the blank 102, so that edges 110 and 116 meet with the folded flap 113 there between having an open edge along line 122. If desired, prior to folding along line 142, the folded flap 113 may be initially stitched along line 144. In either event, the open edge of the folded blank 102 is then stitched from point 150 to point 130 to complete the sleeve 100. The rod 20 may thereafter be inserted in the formed pocket 124 and the cover is completed.

Thus, by utilizing the present invention a compactly storable umbrella cover which may be manufactured from a single blank may be provided without sacrificing the advantages provided by rigid rod support.

It is to be understood that the above described embodiments of the invention are merely illustrative of the principles thereof and that numerous modifications and embodiments of the invention may be derived within the spirit and scope thereof.

What is claimed is:

1. An umbrella cover comprising a sleeve of substantially pliable material having a front and a rear opposed side, with said sleeve having an upper end and a lower end, said lower end being open for receiving the canopy of an umbrella into said sleeve, said front and rear side having first and second edges defining the edges of said sleeve, said front side having an upwardly extending aperture at said first edge thereof extending inwardly from said lower end to a point along said first edge substantially above said lower end so as to expose the interior of said opposed said rear side, said exposed interior forming a backing member for said aperture; a rod retaining pocket portion longitudinally extending along said first edge to said lower end; and a substantially rigid telescoping support rod member retainable within said pocket portion and partially extending along said sleeve first edge in the direction of said sleeve longitudinal axis; whereby said cover may be readily mounted upon said umbrella canopy with said support rod telescopically extended by cooperation between said support rod and said and exposed backing member coverage of said canopy completed by telescopic closure of said support rod.

2. An umbrella cover in accordance with claim 1 further comprising an inner stiffening member at least partially circumferentially extending with said sleeve interior adjacent said lower end and said second edge for facilitating access to said sleeve interior by said umbrella canopy.

3. An umbrella cover in accordance with claim 2 wherein said rod support member is secured within said pocket in said sleeve.

4. An umbrella cover in accordance with claim 3 wherein said stiffening member comprises a plastic webbing strip.

5. An umbrella cover in accordance with claim 1 wherein said sleeve is closed at said upper end.

6. An umbrella cover in accordance with claim 1 wherein said rod support member is secured within said pocket in said sleeve.

7. An umbrella cover in accordance with claim 2 wherein said stiffening member comprises a plastic webbing strip.

8. An umbrella cover in accordance with claim 1 wherein said sleeve is formed from a single blank of said material.

9. An umbrella cover in accordance with claim 6 wherein said secured rod support member has a secured portion longitudinally only partially extending for approximately half the height of said sleeve for facilitating storage of said cover.

10. An umbrella cover in accordance with claim 1 wherein said aperture is substantially triangular in shape.

* * * * *